United States Patent [19]

Schuessler et al.

[11] 4,064,471

[45] Dec. 20, 1977

[54] ELECTROMAGNETIC RELAY

[75] Inventors: John C. Schuessler, West Covina; Marvin G. Nelsen, Irvine; David J. Tapp, Manhattan Beach, all of Calif.

[73] Assignee: Leach Corporation, Los Angeles, Calif.

[21] Appl. No.: 669,215

[22] Filed: Mar. 22, 1976

[51] Int. Cl.[2] ..... H01H 51/22

[52] U.S. Cl. ..... 335/229; 335/78

[58] Field of Search ..... 335/78, 81, 84, 85, 335/229, 230, 235

[56] References Cited

U.S. PATENT DOCUMENTS

| | | | |
|---|---|---|---|
| 3,121,149 | 2/1964 | Richert | 335/84 |
| 3,317,871 | 5/1967 | Adams | 335/230 |
| 3,484,729 | 12/1969 | Adams et al. | 335/200 |
| 3,968,470 | 7/1976 | Brown | 335/230 |
| 4,005,298 | 1/1977 | Brown | 200/153 R |

FOREIGN PATENT DOCUMENTS

| | | | |
|---|---|---|---|
| 775,269 | 5/1957 | United Kingdom | 335/84 |

*Primary Examiner*—George Harris

*Attorney, Agent, or Firm*—Christie, Parker & Hale

[57] ABSTRACT

An electromechanical relay in which an electromagnetic actuator rotates a pivotally supported armature between a first position and a second position by energizing the actuator and rotates the armature back to the first position by de-energizing the actuator. The actuator comprises an electromagnet including a core, a winding on the core, and first and second pole pieces at the respective ends of the core, the pole pieces having pole faces adjacent the same surface of the armature but on opposite sides of the pivot. A permanent magnet is arranged such that a third pole piece forms one pole of the permanent magnet and the electromagnet forms the other pole of the permanent magnet, so that the first and second pole pieces are magnetically polarized to the opposite polarity relative to the third pole piece by the permanent magnet. The pole face of the second pole piece terminates substantially adjacent the pivot, while the pole face of the first pole piece terminates substantially away from the pivot. The third pole piece is positioned relative to the armature on the same side of the pivot as the second pole piece.

5 Claims, 6 Drawing Figures

ELECTROMAGNETIC RELAY

FIELD OF THE INVENTION

The present invention relates to electromechanical relays, and more particularly, to a relay which utilizes a permanent magnet to return the relay to its Off condition when it is de-energized.

BACKGROUND OF THE INVENTION

In the conventional relay, an electromagnet is used to bias an armature from its normally "off" position to its "On" position. Pivoting of the armature operates appropriate switch contacts. When the electromagnet is de-energized, a spring is generally used to return the armature to its "Off"position. However, to provide relays which are acceptable for use in the aerospace industry, high contact pressures and low contact bounce as well as the ability to withstand vibration and high G-forces are required, giving rise to relay designs which prohibit the use of springs. Instead, permanent magnets have been used to secure the armature and contacts in the "Off" position. Such a relay, for example, is described in detail in U.S. Pat. No. 3,484,729, assigned to the same assignee as the present invention. This relay utilizes a magnetic circuit design described in U.S. Pat. No. 3,317,871, also assigned to the assignee of the present invention. The relay described in these patents utilizes a permanent magnet to provide a high holding force to retain the armature in its normal de-energized position and yet permits the armature to rotate rapidly in response to the magnetic force produced by an electromagnet when energized. The permanent magnet pulls the armature back to the "Off" position when the electromagnet is de-energized. However, the magnetic circuit utilized in these relays requires one end of the armature to move in the gap between poles of the permanent magnet in going from the "Off" to the "On" position. Since the moving contacts must be mounted on one side of the armature, the positioning of magnetic poles on both sides of the armature produces mechanical problems in mounting the contacts so that movement of the contacts with rotation of the armature remains clear of the pole pieces. The addition of the third pole on the opposite side of the armature from the poles of the electromagnet makes it more difficult to obtain a compact overall design. The contacts instead of being directly mounted on the armature must be spaced substantially away from the armature, giving rise to the type of contact mounting problems to which U.S. Pat. No. 3,484,729 is directed.

SUMMARY OF THE INVENTION

These and other features of the present invention are achieved by providing a relay in which an electromagnetic actuator rotates the pivotally supported armature between a first position and a second position when energized and rotates the armature back to the first position when de-energized. The actuator comprises an electromagnet, including a core, winding on the core, and first and second pole pieces at the respective ends of the core, whereby the pole pieces are oppositely polarized when the winding is energized from a direct current source. A permanent magnet has a third pole piece forming one pole of the permanent magnet with the core first and second pole pieces forming the other pole of the permanent magnet, whereby the first and second pole pieces are magnetically oppositely polarized relative to the third pole piece by the permanent magnet. The first and second pole pieces have pole faces adjacent the same surface of the armature but on opposite sides of the pivot with the pole face of the second pole piece terminating substantially adjacent the pivot while the pole face of the first pole piece terminates substantially farther away from the pivot. The third pole piece has a pole face positioned adjacent the opposite end of the armature from the first pole piece and further away from the pivot than the second pole piece.

DESCRIPTION OF THE DRAWINGS

For a more complete understanding of the invention reference should be made to the accompanying drawings, wherein.

DETAILED DESCRIPTION

Figure 1:
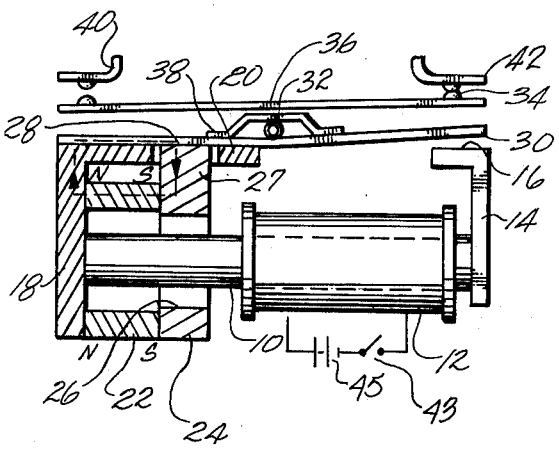
FIGS. 1 and 2 are side elevational views partly in section showing one embodiment of the magnetic actuator of the relay in the Off and On positions, respectively.
Figure 2:
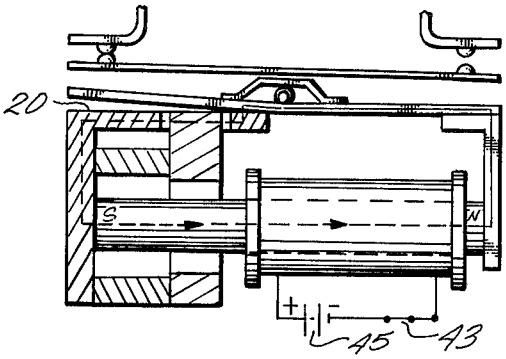

Referring to the arrangement of FIGS. 1 and 2, the magnetic actuator includes an electromagnet consisting of an elongated cylindrical core 10 which extends through a coil winding 12. Attached to one end of the core 10 is a first pole member 14 having a flat pole face 16. Secured to the other end of the core 10 is a second pole member 18 having a flat pole face 20. When the coil 12 is energized from a suitable direct current source (not shown) the pole members 14 and 18 are polarized to the opposite magnetic polarity.

Extending around the core 10 is a permanent magnet of annular shape, as indicated at 22. One end of the permanent magnet is secured to the pole member 18, while the other end of the permanent magnet is secured to pole member 24 having an opening 26 which is substantially larger than the diameter of the core 10 and through which the core 10 passes. The pole member 24 has a portion 27 which projects upwardly and terminates in a flat pole face 28. The pole faces 16, 20 and 28 preferably lie substantially in a common plane.

An elongated armature 30, which is preferably of a slightly V-shape, is pivotally supported at or near its center line relative to the actuator on a pivot pin 32. The pivot is positioned adjacent the pole face 28 and is positioned between the pole face 28 and pole face 16. Rotation of the armature moves one end of the armature toward the pole face 16 and away from the pole faces 20 and 28, while rotation in the opposite direction moves the armature toward the pole faces 20 and 28 and away from the pole face 16.

To provide an electrical switching action for the relay, the armature rotates a pair of moving contacts 34 located at either end of a spring contact member 36 anchored at its center to the armature by a suitable support member 38. Rotation of the armature brings the moving contacts respectively into contact with one or the other of a pair of fixed contacts 40 and 42.

In operation, with the winding 12 de-energized, the armature assumes the "Off" position as shown in FIG. 1 in which flux from the permanent magnet 22 passes between the pole faces 20 and 28 through the portion of the armature on one side of the pivot 32. While the permanent magnet 22 also magnetizes the pole member 14 with the same polarity, because of the much shorter flux path between the pole members 18 and 24, the net torque on the armature is in the counterclockwise direction. When the coil is energized, as by closing a switch 43 to a battery 45, the armature moves to the "On" position, as shown in FIG. 2. Energizing the winding 12 maintains the same polarity of the pole member 14 and at the same time tends to cancel any magnet flux in the pole member 18 flowing into or out of the pole face 28. Thus the net flow of flux is between the pole face 16 and pole faces 20 and 28, the magnetomotive force of the electromagnet and the permanent magnet being additive. Because the pole face 16 is a larger radius from the pivot than the pole face 28 and the net flux at the pole face 28 is small, the net torque is in a clockwise direction causing the armature to rotate to the On position.

When the winding 12 is de-energized the attractive force between the pole face 16 and armature 30 drops substantially while the attractive force between the pole faces 20 and 28 in the armature increases substantially causing the armature to rotate again in the counterclockwise direction. It should be noted that deflection of the contact support 36 also produces a restoring force which tends to move the armature away from the pole face 16 when the winding 12 is de-energized.

Figure 3:
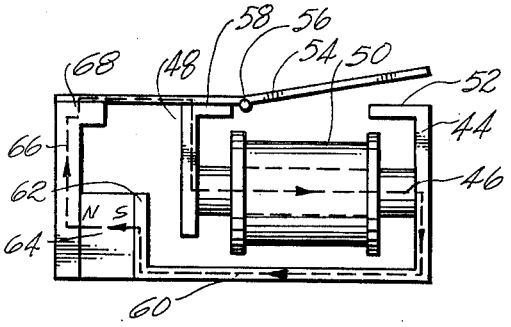
FIGS. 3 and 4 are side elevational views partly in section of an alternative embodiment of the actuator in the On and Off conditions, respectively.
Figure 4:
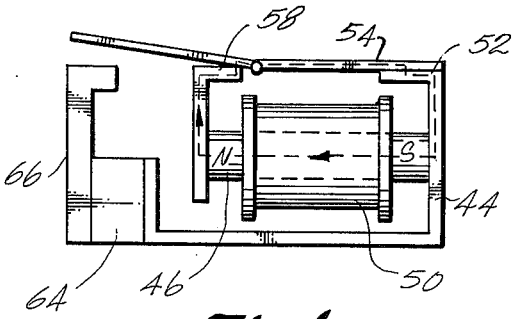

Referring to FIGS. 3 and 4, there is shown an alternative embodiment of the magnetic actuator in which the electromagnet includes a first pole member 44 to which one end of a core 46 is attached, with a second pole member 48 attached to the other end of the core. A winding 50 is mounted on the core. The first pole member 44 has a flat pole face 52 lying adjacent one end of a slightly V-shaped armature 54 pivoted at its center, as indicated at 56. The pole member 48 has a flat pole face 58 positioned on the other side of but closely adjacent to the pivot 56. A horizontal extension 60 of the pole member 44 passes below the coil 50 and terminates in a flange 62. A permanent magnet 64 is secured to the flange 62. A third pole member 66 is connected to the other end of the permanent magnet 64. The third pole member termintes in a pole face 68 adjacent the opposite end of the armature 54 from the pole face 52.

In operation, flux from the permanent magnet 64 passes between the pole faces 58 and 68 through the portion of the armature to the left of the pivot holding the armature in the counterclockwise position. When the coil 50 is energized from a direct current source, the magnetic polarity of the pole face 58 is reversed and the major flux path is between the pole faces 52 and 58, causing the armature to rotate in the clockwise direction to the On position. When de-energized, the permanent magnet causes the armature to pivot to the Off position again.

Figure 5:
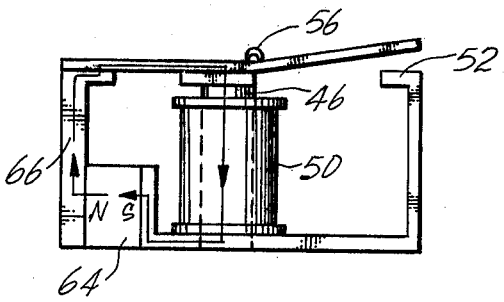
FIGS. 5 and 6 are elevational views partly in section of yet another embodiment.
Figure 6:
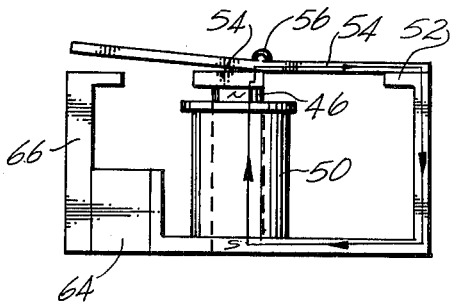

The arrangement shown in FIGS. 5 and 6 is substantially similar to that shown in FIGS. 3 and 4 except that the core extends vertically with one end forming the center pole member. The operation is substantially the same in that the outer pole faces are of opposite polarity and the polarity of the center pole face is reversed when the coil is energized, thus causing the maximum flux to switch from the gap at one end of the armature to the other end of the armature.

What is claimed is:

1. A relay comprising a magnet structure including an electromagnet and a permanent magnet, the electromagnet including a magnetic core, a pair of pole members extending from the ends of the core, and a coil wound on the core, the permanent magnet including a pair of pole members, one of which is common with one of the pole members of the electromagnet, the pole members forming three pole faces, an elongated armature, means pivotally securing the armature to the magnet structure, first and second of the pole faces being positioned adjacent the armature on one side of the pivot axis toward one end of the armature and the third pole face being positioned adjacent the armature on the other side of the pivot toward the other end of the armature such that pivotal movement of the armature moves one end of the armature toward two of the pole faces while moving the other end of the armature away from the third pole face, the air space between the two pole faces on one side of the pivot being substantially smaller than the air gap between either of said pole faces and the third pole face, the permanent magnet polarizing said first and second pole faces in opposite polarity and attracting said armature toward said two pole faces, the coil, when energized, tending to reverse the polarity in one of said two pole faces to reduce the force exerted on the armature by the permanent magnet while polarizing the third pole face to the polarity of the other of said two pole faces.

2. The relay of claim 1 wherein the pole member forming the first pole face has an opening through which the core extends substantially parallel to the armature, the pole member forming the second pole face having a portion extending parallel to the axis of the core back toward the pivot of the armature, the second pole face having an opening through which a portion of the pole member forming the first pole face projects toward the armature.

3. A relay comprising a permanent magnet having first and second pole forming members, said members terminating in pole faces through which magnetic flux passes, an armature, means pivotally supporting the armature between the ends thereof, the pole faces of the first and second pole members being positioned adjacent opposite ends of the armature on either side of the pivot, rotation of the armature moving one end of the armature away from one pole face and toward the other pole face, an electromagnet including a magnetic core and a coil, one end of the core terminating in a third pole forming member having a pole face positioned adjacent the same end of the armature and in close proximity to the pole face of the first pole forming member, the second pole forming member being in low reluctance magnetic contact with the other end of said core.

4. Apparatus of claim 3 wherein the core extends parallel to the armature.

5. Apparatus of claim 3 wherein the core extends perpendicular to the armature, one end of the core forming the second pole piece.

* * * * *